US006050928A

United States Patent [19]

Tsai

[11] Patent Number: 6,050,928

[45] Date of Patent: Apr. 18, 2000

[54] PAPER FOLDING DEVICE

[76] Inventor: Shao-Nong Tsai, No. 17, Lane 267, Hua-Cheng Rd., Hsin-Tien City, Taipei Hsien, Taiwan

[21] Appl. No.: 09/172,097

[22] Filed: Oct. 13, 1998

[51] Int. Cl.[7] ..... B31B 45/14

[52] U.S. Cl. ..... 493/421

[58] Field of Search ..... 493/421, 445

[56] References Cited

U.S. PATENT DOCUMENTS

| | | | |
|---|---|---|---|
| 3,995,849 | 12/1976 | Kistner | 270/68 A |
| 4,465,388 | 8/1984 | Iwasawa | 400/196.1 |
| 4,518,380 | 5/1985 | Shimizu et al. | 493/420 |
| 4,834,699 | 5/1989 | Martin | 493/421 |
| 5,114,395 | 5/1992 | Abramson | 493/421 |
| 5,190,514 | 3/1993 | Galvanauskas | 493/420 |
| 5,437,597 | 8/1995 | Boughton et al. | 493/420 |
| 5,564,684 | 10/1996 | Selancy | 270/45 |
| 5,766,122 | 6/1998 | Hamilton | 493/420 |

*Primary Examiner*—Joseph J. Hail, III
*Assistant Examiner*—Dermott J. Cooke
*Attorney, Agent, or Firm*—Townsend and Townsend and Crew LLP

[57] ABSTRACT

A paper folding device includes a drive roller, a delivery roller and a follower roller extending longitudinally between and mounted rotatably on a pair of partition plates. The delivery roller is mounted slidably on the partition plates so as to permit lateral movement of the delivery roller toward and away from the drive roller. A paper support member extends longitudinally between the partition plates, and is disposed below the delivery roller and the drive roller. The paper support member confines a paper inlet to permit extension of a paper sheet to be folded therein. Rotation of the drive roller forces the paper sheet that extends into the paper support member to bend toward the drive roller and the follower roller so as to be grasped by the latter in order to form a fold in the paper sheet.

15 Claims, 3 Drawing Sheets

PAPER FOLDING DEVICE

BACKGROUND OF THE INVENTION

1. Field of the Invention

The invention relates to a paper folding device for folding sheets of paper.

2. Description of the Related Art

Paper folding devices have been developed to reduce the time and manpower involved when folding a large volume of paper sheets, such as leaflets, handbills, circulars and the like. However, it is noted that conventional paper folding devices seldom incorporate self-alignment mechanisms for aligning the paper sheets during the folding operation to avoid jamming of the device.

SUMMARY OF THE INVENTION

Therefore, the object of the present invention is to provide a simple yet reliable paper folding device that is capable of folding paper sheets.

According to the present invention, a paper folding device comprises an elongated drive roller, an elongated delivery roller and an elongated first follower roller extending longitudinally between and mounted rotatably on a spaced pair of parallel partition plates. The delivery roller is parallel to and is disposed on one side of the drive roller. The first follower roller is parallel to and is disposed below the drive roller. The delivery roller is mounted slidably on the partition plates so as to permit lateral movement of the delivery roller toward and away from the drive roller. A cam unit includes a cam follower provided on one end of the delivery roller, and a cam wheel coupled to one end of the drive roller. The cam wheel acts on the cam follower and rotates with the drive roller during a paper folding operation from an initial paper inserting position, where the cam wheel pushes the cam follower to move the delivery roller away from the drive roller so as to form a clearance between the delivery roller and the drive roller in order to permit insertion of a paper sheet to be folded between the delivery roller and the drive roller, and a paper feeding position, where the cam wheel ceases to push the cam follower to permit movement of the delivery roller toward the drive roller for clamping the paper sheet to be folded between the delivery roller and the drive roller. A first paper support member extends longitudinally between the partition plates and is disposed below the delivery roller and the drive roller. The first paper support member confines a first paper inlet that is accessible via the clearance to permit extension of the paper sheet to be folded therein.

Rotation of the drive roller causes the cam wheel to move from the paper inserting position to the paper feeding position, and forces the paper sheet that extends into the first paper support member to bend toward the drive roller and the first follower roller so as to be grasped by the drive roller and the first follower roller in order to form a first fold in the paper sheet.

In a preferred embodiment, the paper folding device further includes an elongated second follower roller that extends longitudinally between and that is mounted rotatably on the partition plates, and a second paper support member that extends longitudinally between the partition plates and that is disposed below the second follower roller and the drive roller. The second follower roller is parallel to and is disposed on another side of the drive roller opposite to the delivery roller. The second paper support member confines a second paper inlet to permit the paper sheet with the first fold to fall therein after being released from the drive roller and the first follower roller.

Continued rotation of the drive roller forces the paper sheet that extends into the second paper support member to bend toward the drive roller and the second follower roller so as to be grasped by the drive roller and the second follower roller in order to form a second fold in the paper sheet.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
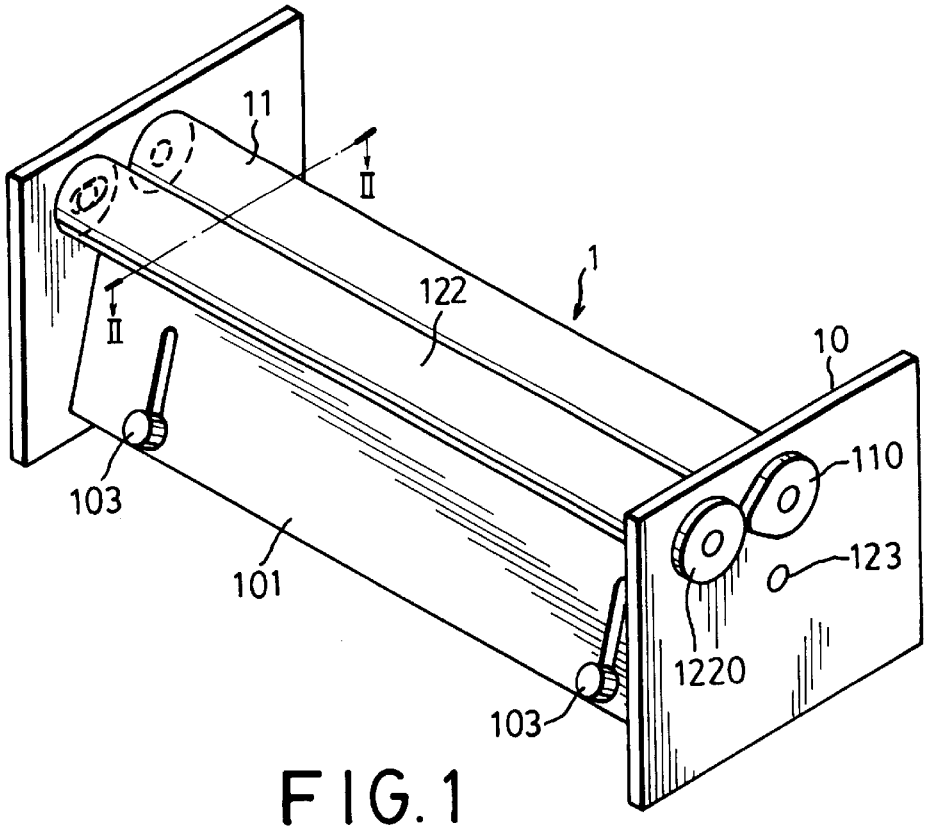
FIG. 1 is a perspective view of the first preferred embodiment of a paper folding device according to the present invention.

Before the present invention is described in greater detail, it should be noted that like elements are denoted by the same reference numerals throughout the disclosure.

Figure 2:
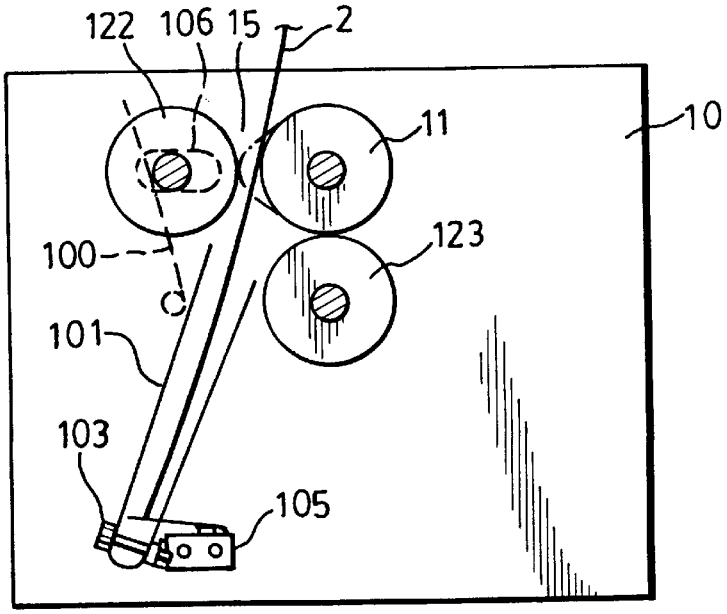
FIG. 2 is a sectional view of the first preferred embodiment, taken along line II—II in FIG. 1, to illustrate a paper inserting operation thereof.

Referring to FIGS. 1 and 2, the first preferred embodiment of a paper folding device 1 according to the present invention is shown to comprise a spaced pair of parallel partition plates 10, an elongated drive roller 11, an elongated delivery roller 122, an elongated follower roller 123, a cam unit constituted by a cam wheel 110 and a cam follower 1220, and a paper support member 101.

The rollers 11, 122, 123 extend longitudinally between and are mounted rotatably on the partition plates 10. The delivery roller 122 is parallel to and is disposed on a left side of the drive roller 11. The follower roller 123 is parallel to and is disposed below the drive roller 11. The partition plates 10 are formed with aligned horizontal slots 106 at the left side of the drive roller 11. The delivery roller 122 has opposite ends that extend respectively and slidably into the slots 106 to permit lateral movement of the delivery roller 122 toward and away from the drive roller 11. The cam follower 1220 is provided on one of the ends of the delivery roller 122. The cam wheel 110 is coupled to one end of the drive roller 11 and acts on the cam follower 1220. The cam wheel 110 rotates with the drive roller 11 during a paper folding operation from an initial paper inserting position to a paper feeding position. In the paper inserting position, the cam wheel 110 pushes the cam follower 1220 to move the delivery roller 122 away from the drive roller 11 so as to form a clearance 15 between the rollers 11, 122 in order to permit insertion of a paper sheet 2 to be folded between the rollers 11, 122. In the paper feeding position, the cam wheel 110 ceases to push the cam follower 1220 to permit movement of the delivery roller 122 toward the drive roller 11 for clamping the paper sheet 2 to be folded between the rollers 11, 122. A spring unit is formed as a leaf spring 100 having one end mounted on one of the partition plates 10, and another end acting on the delivery roller 122. The leaf spring 100 biases the delivery roller 122 toward the drive roller 11. The paper support member 101 extends longitudinally between the partition plates 10, and is disposed below the delivery roller 122 and the drive roller 11. The paper support member 101 confines a paper inlet that is inclined downwardly and leftward with respect to the rollers 11, 122, 123. The paper inlet of the paper support member 101 is accessible via the clearance 15 to permit extension of the paper sheet 2 to be folded therein. A limit unit includes a pair of limit members 103 that are mounted adjustably on the paper support member 101 to adjust an (effective depth of the paper support member 101. A contact switch 105 is disposed in the paper support member 101, and is mounted on one of the limit members 103 so as to be movable therewith relative to the paper support member 101.

Initially, the cam wheel 110 pushes the cam follower 1220 to move the delivery roller 122 away from the drive roller 11 against the action of the leaf spring 100, thereby resulting in the clearance 15 between the rollers 11, 122 for access to the paper inlet of the paper support member 101. A stack of paper sheets 2 (only one paper sheet 2 is shown for the sake of clarity) can be extended into the paper support member 101 at this time. Since the paper inlet of the paper support member 101 is inclined with respect to the rollers 11, 122, 123, the paper sheets 2 naturally sag or bow toward the rollers 11, 123 when extended into he paper support member 101. The limit members 103 serve to align bottom edges of the paper sheets 2 in the paper support member 101. The contact switch 105 is activated when the bottom edges of the paper sheets 2 contact the same. The contact switch 105 forms part of a drive unit that causes the drive roller 11 to rotate for performing a paper folding operation once the contact switch 105 is activated.

Figure 3:
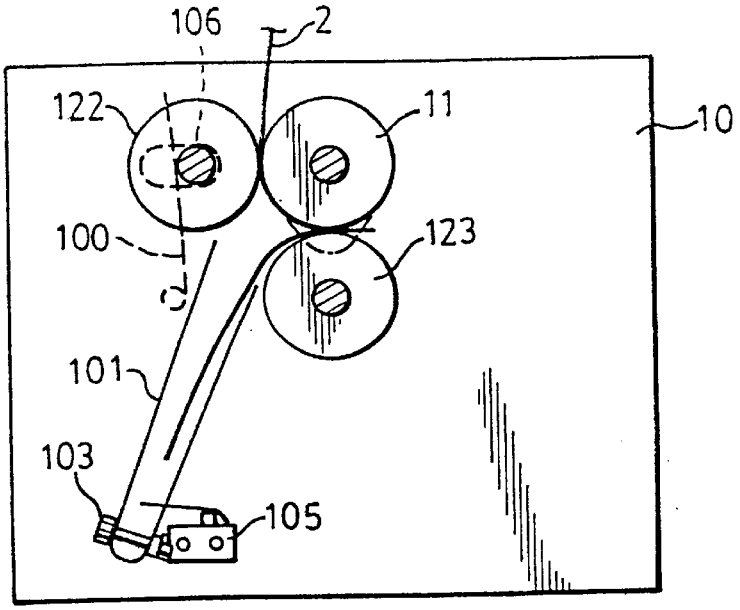
FIG. 3 is another sectional vies of the first preferred embodiment, taken along line II—II in FIG. 1, to illustrate a paper folding operation thereof.

When the drive roller 11 rotates from its initial paper inserting position to the paper feeding position, it ceases to push the cam follower 1220 so as to result in movement of the delivery roller 122 toward the drive roller 11 due to the action of the leaf spring 100, as shown in FIG. 3. The paper sheets 2 can be clamped between the rollers 11, 122 at this time. Continued rotation of the drive roller 11 causes the paper sheets 2 that extend into the paper support member 101 to bow or bend toward the drive roller 11 and the follower roller 123 so as to be grasped by the rollers 11, 123 in order to form a fold in the paper sheets 2.

By adjusting the positions of the limit members 103 on the paper support member 101 to adjust the effective depth of the latter, the position of the fold in the paper sheets 2 can be adjusted.

Figure 4:
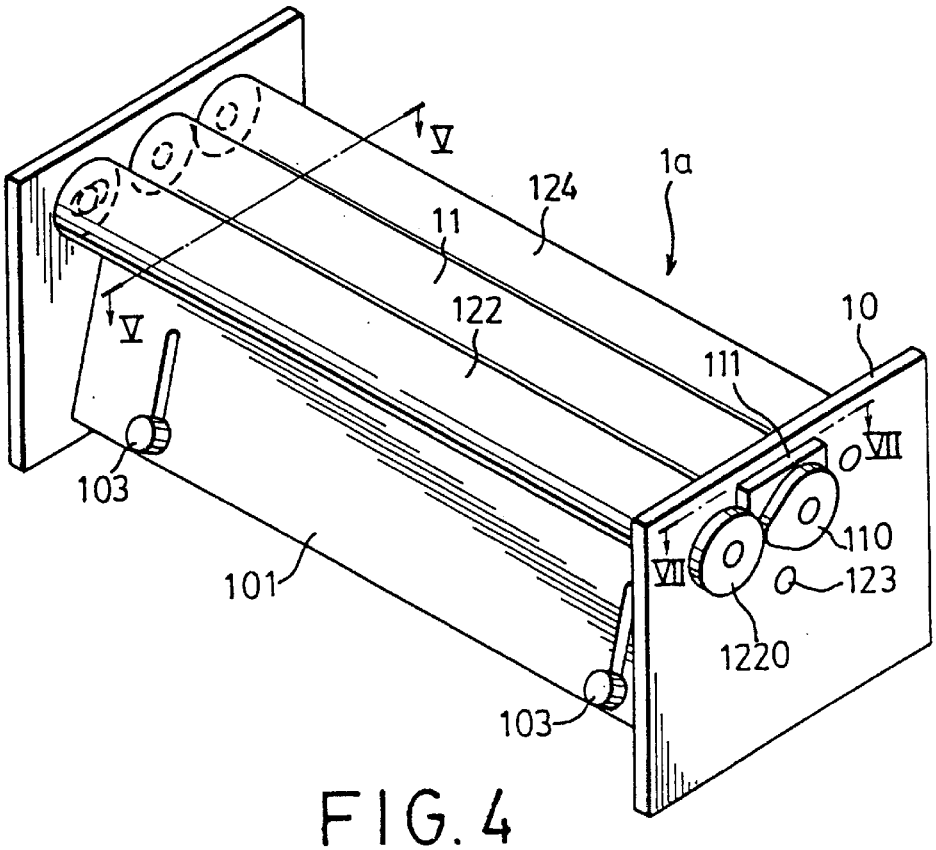
FIG. 4 is a perspective view of the second preferred embodiment of a paper folding device according to the present invention.
Figure 5:
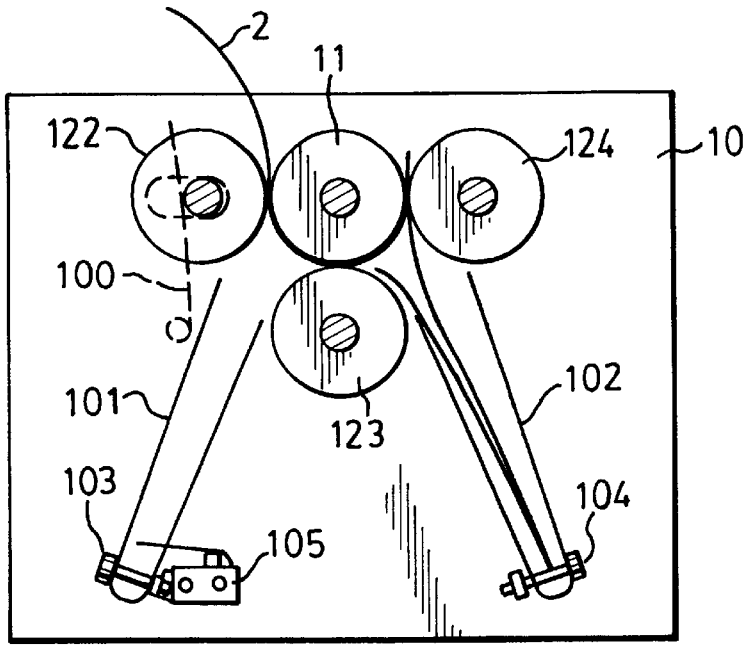
FIG. 5 is a sectional view of the second preferred embodiment, taken along line V—V in FIG. 4, to illustrate a paper folding operation thereof.

FIGS. 4 and 5 illustrate the second preferred embodiment of a paper folding device la according to the present invention. Unlike the previous embodiment, the paper folding device 1*a* further includes an elongated second follower roller 124 and a second paper support member 102. The second follower roller 124 extends longitudinally between and is mounted rotatably on the partition plates 1. The second follower roller 124 is parallel to and is disposed on a right side of the drive roller 11. Like the delivery roller 122 and the follower roller 123, the second follower roller 124 is driven rotatably by the drive roller 11. The second paper support member 102 extends longitudinally between the partition plates 10, and is disposed below the second follower roller 124 and the drive roller 11. The second paper support member 102 confines a second paper inlet that is inclined downwardly and rightward with respect to the rollers 11, 123, 124. As such, the folded paper sheets 2 released from the drive roller 11 and the first follower roller 123 can fall into the second paper support member 102. A second limit unit includes a pair of second limit members 104 (only one is shown in FIG. 5) that are mounted adjustably on the second paper support member 102 to adjust an effective depth of the latter.

Figure 6:
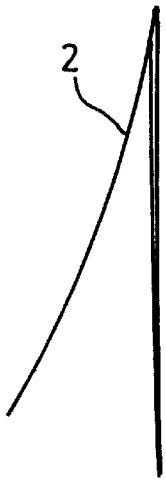
FIG. 6 illustrates a paper sheet that is folded using the device of the second preferred embodiment.

In use, after a first fold has been made in the paper sheets 2 in the manner described in connection with the operation of the first preferred embodiment, the folded paper sheets 2 subsequently fall into the second paper support member 102 via the second paper inlet. When the folded paper sheets 2 reach the second limit members 104, continued feeding of the paper sheets 2 due to the rotation of the drive roller 11 will cause the paper sheets 2 to bend or buckle once again, this time toward the drive roller 11 and the second follower roller 124. The paper sheets 2 are then grasped by the rollers 11, 124 in order to make a second fold in the same. A paper sheet 2 folded by the device 1*a* of the second preferred embodiment is shown in FIG. 6.

Like the limit members 103 on the paper support member 101, the second limit members 104 on the second paper support member 102 are adjustable to adjust the effective depth of the latter, and thus, the position of the second fold in the paper sheets 2.

Referring again to FIGS. 4 and 5, after the folded paper sheets 2 have been released from the rollers 11, 124, the cam wheel 110 once again pushes the cam follower 1220 against the action of the leaf spring 100 so that the delivery roller 122 moves away from the drive roller 11 in preparation for another paper folding operation.

Figure 7:
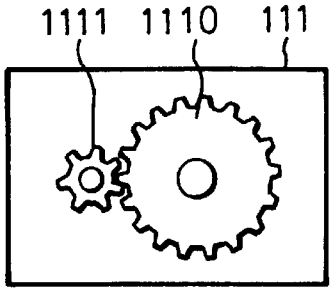
FIG. 7 is another sectional view of the second preferred embodiment, taken along line VII—VII in FIG. 4, to illustrate a speed reducing gear set thereof.

The paper folding device 1, 1*a* of the present invention is suitable for use with paper sheets 2 of various lengths. Because the circumference of the drive roller 11 is fixed, a speed reducing gear set 111 is employed to couple the cam wheel 110 to the drive roller 11 in order to prevent the delivery roller 122 from repeatedly moving toward and away from the drive roller 11 during a single paper folding operation. As shown in FIG. 7, the speed reducing gear set 111 includes a large-diameter gear 1110 meshing with a small-diameter gear 1111. The speed reducing gear set 111 ensures that the cam wheel 110 pushes away the delivery roller 122 only once during a paper folding operation.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A paper folding device comprising:

a spaced pair of parallel partition plates;

an elongated drive roller, an elongated delivery roller and an elongated first follower roller extending longitudinally between and mounted rotatably on said partition plates, said drive roller having a drive roller axis and said delivery roller having a delivery roller axis, said delivery roller being parallel to and being disposed on one side of said drive roller, said first follower roller being parallel to and being disposed below said drive roller, said delivery roller being mounted slidably on said partition plates so as to permit lateral movement of said delivery roller toward and away from said drive roller;

a cam unit including a cam follower provided as an extension of one end of said delivery roller, for rotationally engaging a cam wheel coupled as a similarly end-positioned extension of one of said drive roller, said cam wheel acting on said cam follower and rotating with said drive roller during a paper folding operation from an initial paper inserting position, where said cam wheel pushes said cam follower to move said delivery roller away from said drive roller with said delivery roller axis moving away from said drive roller axis so as to form a clearance between said delivery roller and said drive roller in order to permit insertion of a paper sheet to be folded between said delivery roller and said drive roller, and a paper feeding position, where said cam wheel ceases to push said cam follower to permit movement of said delivery roller toward said drive roller with said delivery roller axis moving toward said drive roller axis for clamping the paper sheet to be folded between said delivery roller and said drive roller; and a first paper support member extending longitudinally between said partition plates and disposed below said delivery roller and said drive roller, said first paper support member confining a first paper inlet that is accessible via said clearance to permit extension of the paper sheet to be folded therein;

rotation of said drive roller causing said can wheel to move from the paper inserting position to the paper feeding position, and forcing the paper sheet that extends into said first paper support member to bend toward said drive roller and said first follower roller so as to be grasped by said drive roller and said first follower roller in order to form a first fold in the paper sheet.

2. The paper folding device as claimed in claim 1, wherein said first paper inlet inclines downwardly to permit the paper sheet to be folded to bow naturally toward said drive roller and said first follower roller.

3. The paper folding device as claimed in claim 1, wherein said partition plates are formed with aligned horizontal slots at said one side of said drive roller, said delivery roller having opposite ends that extend respectively into said horizontal slots for mounting rotatably and slidably said delivery roller on said partition plates.

4. The paper folding device as claimed in claim 1, further comprising a spring unit mounted on one of said partition plates for biasing said delivery roller toward said drive roller.

5. The paper folding device as claimed in claim 4, wherein said spring unit is a leaf spring having one end mounted on said one of said partition plates, and another end acting on said delivery roller.

6. The paper folding device as claimed in claim 1, further comprising a drive unit that includes a contact switch disposed in said first paper support member and adapted to be activated by the paper sheet that is to be folded and that is extended into said first paper support member, said drive unit driving said drive roller to rotate to initiate the paper folding operation once said contact switch is activated.

7. The paper folding device as claimed in claim 6, further comprising a limit unit mounted adjustably on said first paper support member to adjust an effective depth of said first paper support member so as to adjust position of the first fold in the paper sheet.

8. The paper folding device as claimed in claim 7, wherein said contact switch is mounted on said limit unit so as to be movable therewith relative to said first paper support member.

9. The paper folding device as claimed in claim 1, further comprising:

an elongated second follower roller extending longitudinally between and mounted rotatably on said partition plates, said second follower roller being parallel to and being disposed on another side of said drive roller opposite to said delivery roller; and a second paper support member extending longitudinally between said partition plates and disposed below said second follower roller and said drive roller, said second paper support member confining a second paper inlet to permit the paper sheet with the first fold to fall therein after being released from said drive roller and said first follower roller;

continued rotation of said drive roller forcing the paper sheet that extends into said second paper support member to bend toward said drive roller and said second follower roller so as to be grasped by said drive roller and said second follower roller in order to form a second fold in the paper sheet.

10. The paper folding device as claimed in claim 9, wherein said delivery roller, said first follower roller and said second follower roller are driven rotatably by said drive roller.

11. The paper folding device as claimed in claim 1, further comprising a speed reducing gear set mounted on one of said partition plates and coupling said cam wheel to said drive roller.

12. The paper folding device as claimed in claim 11, wherein said speed reducing gear set includes a small-diameter gear and a large-diameter gear meshing with said small-diameter gear.

13. The paper folding device as claimed in claim 9, further comprising a limit unit mounted adjustably on said second paper support member to adjust an effective depth of said second paper support member so as to adjust position of the second fold in the paper sheet.

14. The paper folding device as claimed in claim 1, wherein said cam follower has a circular cam follower surface.

15. The paper folding device as claimed in claim 14, wherein said cam wheel has a noncircular cam wheel surface for contacting said circular cam follower surface.

* * * * *